United States Patent [19]

Kaufman et al.

[11] 4,412,845

[45] Nov. 1, 1983

[54] ETHANOL OR GASOHOL FUEL COMPOSITION CONTAINING AS INHIBITOR A REACTION PRODUCT OF ITACONIC ACID AND MONO-OLEYL-1,3-DIAMINOPROPANE

[75] Inventors: Benjamin J. Kaufman; William M. Sweeney, both of Wappingers Falls, N.Y.

[73] Assignee: Texaco Inc., White Plains, N.Y.

[21] Appl. No.: 408,324

[22] Filed: Aug. 16, 1982

[51] Int. Cl.[3] ..... C10L 1/22

[52] U.S. Cl. ..... 44/53; 44/56; 44/63

[58] Field of Search ..... 44/56, 63, 53

[56] References Cited

U.S. PATENT DOCUMENTS

| | | | |
|---|---|---|---|
| 3,303,007 | 2/1967 | Mueller | 44/56 |
| 4,247,300 | 1/1981 | Bonazzi et al. | 44/63 |
| 4,282,007 | 8/1981 | Sung | 44/56 |
| 4,365,972 | 12/1982 | Sung et al. | 44/53 |

*Primary Examiner*—Charles F. Warren
*Assistant Examiner*—Y. Harris-Smith
*Attorney, Agent, or Firm*—Robert A. Kulason; Robert Knox, Jr.; Carl G. Seutter

[57] ABSTRACT

A novel fuel composition contains ethanol or gasohol plus, as a wear-inhibiting additive, a reaction product of one mole of itaconic acid and two moles of N-mono-oleyl-1,3-diaminopropane.

26 Claims, No Drawings

ETHANOL OR GASOHOL FUEL COMPOSITION CONTAINING AS INHIBITOR A REACTION PRODUCT OF ITACONIC ACID AND MONO-OLEYL-1,3-DIAMINOPROPANE

FIELD OF THE INVENTION

This invention relates to a fuel composition for internal combustion engines particularly characterized by wear inhibition.

BACKGROUND OF THE INVENTION

As is well known to those skilled in the art, fuel composition typified by gasohol and alcohols which are to be considered for commercial use must possess anti-wear activity; and this may be effected by addition thereto of various inhibition systems.

A wide variety of compounds have been tested for this purpose. Many of these compounds are nitrogen-containing compounds. Interesting nitrogen-containing compounds include those disclosed in U.S. Pat. No. 4,326,050 or U.S. Pat. No. 4,332,720, or U.S. Pat. No. 4,315,079 to Schulze et al; U.S. Pat. No. 2,993,021 to Bavley et al; Paytash et al JACS 72, 1415 (1950), etc.

It is an object of this invention to provide a fuel composition for internal combustion engines particularly characterized by wear inhibition. Other objects will be apparent to those skilled in the art.

STATEMENT OF THE INVENTION

In accordance with certain of its aspects, the fuel composition of this invention may comprise (a) a major portion of a fuel containing (i) at least one alcohol selected from the group consisting of ethanol and methanol and (ii) gasoline in amount of 0–50 volumes per volume of alcohol; and (b) a minor wear-inhibiting amount of, as a wear-inhibiting additive, a reaction product of one mole of the acid

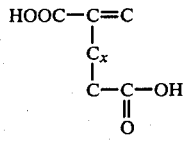

wherein x is an integer 0-2; and two moles of the amine $$R'NH—R''—NH_2$$

wherein R′ is alkyl, alkenyl, alkaryl, aralkyl, aryl, cycloalkenyl or cycloalkyl and R″ is alkylene, cycloalkylene, aralkylene, alkarylene, arylene or polyoxyalkylene.

DESCRIPTION OF THE INVENTION

The fuel for internal combustion engines which may be-treated by the process of this invention may contain (i) at least one alcohol selected from the group consisting of ethanol and methanol and (ii) gasoline in amount of 0–50 volumes per volume of alcohol. The fuel may be an alcohol-type fuel containing little or no hydrocarbon. Typical of such fuels are methanol, ethanol, mixtures of methanol-ethanol, etc. Commercially available mixtures may be employed. Illustrative of one such commercially available mixture may be that having the following typical analysis.

TABLE I

| Component | Parts |
|---|---|
| ethanol | 3157.2 |
| methyl isobutyl ketone | 126.3 |
| acetic acid | 0.256 |
| methyl alcohol | 0.24 |
| isopropyl alcohol | 0.2 |
| n-propyl alcohol | 0.162 |
| ethyl acetate | 0.2 |

The fuels which may be treated by the process of this invention include gasohols which may be formed by mixing 90–95 volumes of gasoline with 5–10 volumes of ethanol or methanol. A typical gasohol may contain 90 volumes of gasoline and 10 volumes of absolute alcohol.

It is preferred that the fuels to be treated by the process of this invention be substantially anhydrous, i.e. that they contain less than about 0.3 v % water; typically they may contain 0.0001 v %–0.0005 v %, say about 0.04 v % water.

It is a feature of these fuels that they may undesirably contain acidic contaminants which may cause serious corrosion problems. These contaminants are particularly in evidence when the alcohol is a commercially available alcohol which contains therein inter alia acids concurrently produced as by fermentation processes for producing ethanol or acids which have been picked up during handling. Acetic acid is a common acid present in the commercially available alcohols produced by fermentation; and it may be present in amount of 0.003 w %–0.005 w % of the total of the alcohol.

In accordance with practice of the process of this invention, there may be added to the fuel a minor wear-inhibiting amount of, as a wear-inhibiting additive, a reaction product of one mole of the acid

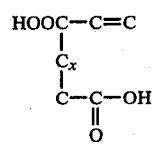

wherein x is an integer 0–2; and two moles of the amine $$R'NH—R''—NH_2$$

wherein R′ is an alkyl or cycloalkyl hydrocarbon group and R″ is an alkylene, cycloalkylene, aralkylene, alkarylene, or arylene hydrocarbon group or a polyoxyalkylene group.

The charge unsaturated carboxylic acids which may be used in practice of the process of this invention are characterized by the formula

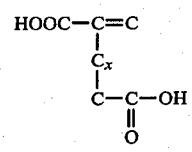

wherein x is an integer 0–2. Valence bonds in this structure, or in others in this specification, may be filled with hydrogen or with inert substituents which do not interfere with the reaction.

When x is 2, the acid may be represented by the formula (typified by alpha-methylene adipic acid):

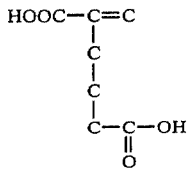

When x is 1, the acid may be represented by the formula (typified by alpha-methylene glutaric acid):

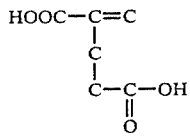

When x is 0, the acid may be represented by the formula (typified by itaconic acid):

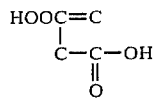

In the preferred acid, itaconic acid, x is zero.

The amines which may be employed include polyamines, preferably diamines, which bear at least one free primary amine-$NH_2$ group and at least one substituted primary amine group. The latter may be di-substituted, but more preferably it is mono-substituted. The nucleus of the amine may be aliphatic or aromatic-including alkyl, alkaryl, aralkyl, aryl, or cyclalkyl or polyoxyalkylene. The preferred amines may be of the formula $$R'NH—R''—NH_2$$

i.e., monosubstituted diprimary amines. In the preferred diamines (preferably N-alkylene diamines), the R'' group may be alkylene, aralkylene, alkarylene, arylene, or cycloalkylene. R'' may preferably possess 2–6 carbon atoms when R'' is polyoxyalkylene, it may be polyoxyethylene, polyoxypropylene, etc and preferably have a molecular weight $\overline{M}_n$ of 300–2100. The R' group may be a $C_{12}$–$C_{18}$ alkyl, alkenyl, alkaryl, aralkyl, aryl, or cycloalkyl hydrocarbon moiety.

Illustrative of the preferred N-mono-alkyl alkylene diamines may include:

A. The Duomeen O brand of N-mono-oleoyl-1, 3-propane diamine;

B. The Duomeen S brand of N-mono-stearyl-1, 3-propane diamine;

C. The Duomeen T brand of N-mono-tallow-1, 3-propane diamine.

D. The Duomeen C brand of N-mono-coco-1, 3-propane diamine.

E. The Duomeen L-11 brand of N-mono-beta undecyl-1, 3-propane diamine.

F. The Duomeen OL brand (or the Armogard G-505 brand) of N-mono-oleyl-1, 3-diaminopropane.

The preferred R'NH-R''—$NH_2$ is that wherein the R'' group is propylene-$CH_2CH_2CH_2$-and the R' group may be a $C_{12}$–$C_{18}$ n-alkenyl group. The most preferred composition may be $R'—NH—CH_2CH_2CH_2NH_2$ wherein R' is a $C_{18}$ straight chain alkenyl group.

It will be apparent to those skilled in the art that the several reactants may bear inert substituents which are typified by alkyl, alkoxy, nitro, cyano, etc. It will also be apparent that the preferred compounds to be employed will be those which are soluble in the solvents employed during the reaction and which produce products which are soluble in or compatible with the system in which the product is to be employed.

Typical polar solvents which may be employed include dimethyl formamide, tetrahydrofuran, dimethyl sulfoxide. A particularly preferred system may include dimethyl formamide.

Typical non-polar solvents which may be employed may include toluene, xylene, ethylbenzene, kerosene, gasoline, etc. The preferred solvent may be commercial mixed xylenes.

Formation of the desired compound may be preferably effected by placing one mole of the acid in reaction vessel dissolved in an excess of solvent. Solvent may be present in amount of 1–10, preferably 1–5, say about 3 ml per g of acid. The amine may be added slowly over 0.1–3, say about 1 hour in total amount of about 2 moles per mole of acid. Temperature of operation may be 20° C.–50° C., say 40° C.

At the conclusion of the addition, the mixture is heated to 80° C.–180° C., say about 140° C. and water is azeotropically removed with the xylene. Reaction mixture is maintained at this temperature until water is no longer recovered, typically 4–8 hours, say about 6 hours. The xylene is then removed as by vacuum stripping at typically 20° C.–140° C., say 60° C. at 5–100 mm Hg, say 10 mm Hg.

The following reaction typically occurs:

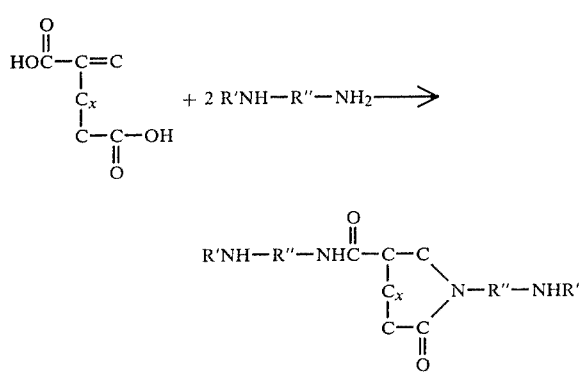

It will be apparent to those skilled in the art, that isomers of the above product may be formed (or exist in equilibrium in the product) including those typified by:

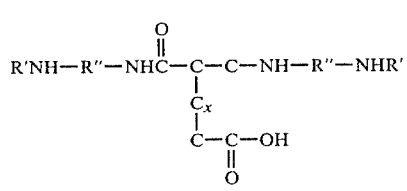

-continued

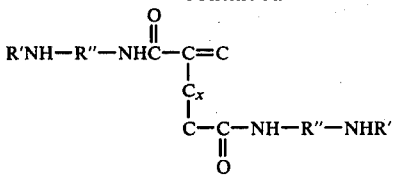

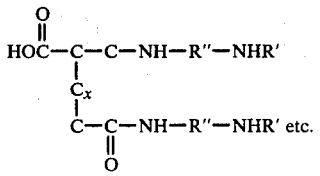

The following reaction typically occurs in the case of the preferred itaconic acid and N-mono-oleyl-2,3-diaminopropane:

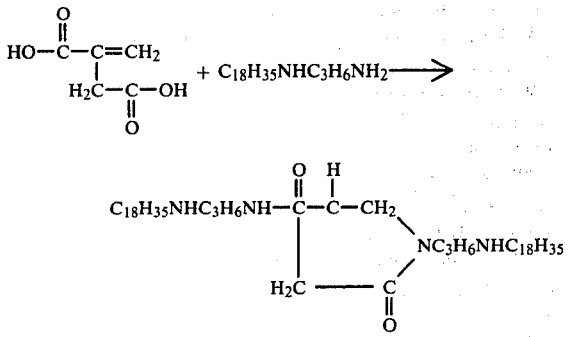

The reaction product may be a waxy solid or viscous liquid recovered in yield approaching stoichiometric.

The so-prepared anti-wear additives may be added to fuels (including alcohol, gasoline, gasohol, etc.) or to antifreeze. These compositions may be particularly found to be effective when added to absolute alcohol fuels typified by those available commercially containing compounds including ethers, esters, acids, etc.

The so-prepared anti-wear additives may be added to a fuel in amount of 1–2500 PTB, preferably 5–2000 PTB, more preferably 100–1500 PTB, say 1000 PTB. (PTB stands for pounds of additive per thousand barrels of fuel). Alternatively expressed, the additive may be added to a fuel in minor wear-inhibiting amount of about 0.003–10 w % preferably 0.01–6 w %, more preferably 0.2–3 w %, say 1 w %. Larger amounts may be employed but may not be necessary.

It is a feature of this invention that the fuel composition so prepared is characterized by its increased ability to significantly reduce scar diameters (wear) in the Four-Ball Wear Test.

The Four Ball Wear Test is carried out by securely clamping three highly polished steel balls (each 0.5 inch in diameter) in a test cup in an equilateral triangle in a horizontal plane. The fourth highly polished steel ball, resting on the three lower balls to form a tetrahedron, is held in a chuck. A weight lever arm system applies weight to the test cup, and this load holds the balls together. In the standard test, the speed of rotation is 1800 rpm; the load is 5 kilograms. The assembly is submerged in the liquid to be tested. The standard test is carried out at ambient temperature for 30 minutes. As the chuck and upper ball rotate against the fixed lower balls, the friction of the upper ball rotating in relation to the lower balls produces a wear-scar the diameter of which (i.e. the depth along a diameter of the ball) is measured. The average of the wear on the three lower balls is the rating assigned (in millimeters).

It is observed that the use of the technique of this invention permits reduction in the average scar diameter by as much as 25%–30%. A reduction of 10% is a significant reduction.

DESCRIPTION OF PREFERRED EMBODIMENTS

Practice of this invention will be apparent to those skilled in the art from the following examples wherein, as elsewhere in this specification, all parts are parts by weight unless otherwise specified.

EXAMPLE I

In this example which illustrates the best mode known to me of practicing the process of this invention, 65 g (0.5 M) of itaconic acid in 200 ml xylene is placed in a reaction vessel at 25° C. There is added dropwise over 20 minutes 342 g (1.0 M) of the Duomeen OL brand of N-mono-oleyl-1,3,-diaminopropane.

The reaction mixture is heated to azeotroping temperature and maintained at that temperature (140° C.) until no more water is removed. The xylene is then vacuum stripped at 60° C./10 mm Hg. Product is found to contain 6.06 w% nitrogen and to have a molecular weight of 1060.

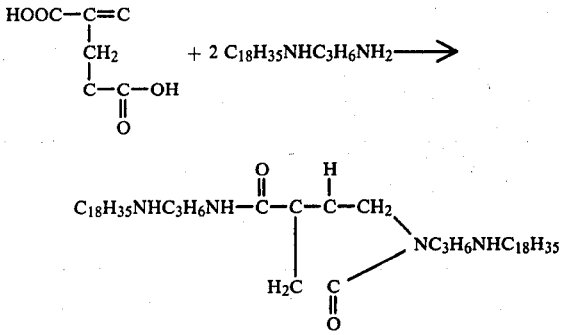

Results comparable to those of Example I may be obtained if the acid is:

| Example | Acid |
|---|---|
| II | alpha-methylene glutaric acid |
| II | alpha-methylene adipic acid |

Results comparable to those of Example I may be obtained if the amine is:

| Example | Amine |
|---|---|
| IV | The Cuomeen S brand of N—mono-stearyl-1,3-propane diamine. |
| V | The Duomeen T brand of N—mono-tallow-1,3-propane diamine. |
| VI | The Duomeen C brand of N—mono-coco-1,3-propane diamine. |
| VII | The Duomeen L-11 brand of N—mono-beta undecyl-1,3-propane diamine. |

EXAMPLE VIII*

In this control example, the commercially available alcohol of Table I supra is tested in the Four Ball Wear Test for 30 minutes at room temperature using a load of 5 kg and a speed of 1,800 rpm. The scar diameter is 0.39 millimeter.

EXAMPLE IX

In this example, the product of Example I is added, in amount of 0.1 w%, to the base fuel of Example VIII*. The scar diameter is 0.34 millimeter.

EXAMPLE X*

In this control example, the alcohol tested is commercial methanol. The scar diameter is 0.34 millimeter.

EXAMPLE XI

In this example, the product of Example I is added, in amount of 0.1 w%, to the methanol base fuel of Example X. The scar diameter is 0.25 millimeter.

TABLE

| Example | Base Fuel | Additive | Scar Diameter Millimeters |
|---|---|---|---|
| VIII* | Commercial Ethanol | none | 0.39 |
| IX | " | Example I | 0.34 |
| X* | Methanol | none | 0.34 |
| XI | " | Example I | 0.25 |

From the above table, it will be apparent to those skilled in the art that it is possible to readily reduce the wear by as much as 27%.

Results comparable to those of Examples IX and XI may be obtained if the fuel is as follows:

TABLE

| Example | Fuel |
|---|---|
| XII | Gasohol contain 90 v % gasoline and 10 v % absolute ethanol |
| XIII | Absolute ethanol |

Although this invention has been illustrated by reference to specific embodiments, it will be apparent to those skilled in the are that various changes and modifications may be made which clearly fall within the scope of this invention.

We claim:

1. A fuel composition for internal combustion engines comprising (a) a major portion of a fuel containing (i) at least one alcohol selected from the group consisting of ethanol and methanol and (ii) gasoline in amount of 0–50 volumes per volume of alcohol; and (b) a minor wear-inhibiting amount of, as a wear-inhibiting additive, a reaction product of one mole of the acid

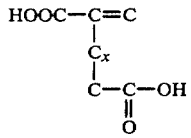

wherein x is an integer 0–2; and two moles of the amine $R'NH—R''—NH_2$ wherein R′ is alkyl, alkenyl, alkaryl, aralkyl, aryl, cycloalkenyl or cycloalkyl and R″ is an alkylene, cycloalkylene, aralkylene, alkarylene, or arylene or polyoxyalkylene.

2. A fuel composition for internal combustion engines as claimed in claim 1 wherein said fuel is an alcohol.

3. A fuel composition for internal combustion engines as claimed in claim 1 wherein said fuel is methanol.

4. A fuel composition for internal combustion engines as claimed in claim 1 wherein said fuel is ethanol.

5. A fuel composition for internal combustion engines as claimed in claim 1 wherein said fuel is a commercial ethanol.

6. A fuel composition for internal combustion engines as claimed in claim 1 wherein said fuel is a commercial ethanol containing acid.

7. A fuel composition for internal combustion engines as claimed in claim 1 wherein said fuel is a commercial ethanol containing acetic acid.

8. A fuel composition for internal combustion engines as claimed in claim 1 wherein said fuel is gasohol.

9. A fuel composition for internal combustion engines as claimed in claim 1 wherein said fuel is substantially anhydrous.

10. A fuel composition for internal combustion engines as claimed in claim 1 wherein said fuel contains less than 0.3 v % water.

11. A fuel composition for internal combustion engines as claimed in claim 1 where in said acid is itaconic acid.

12. A fuel composition for internal combustion engines as claimed in claim 1 where in said acid is alpha-methylene glutaric acid.

13. A fuel composition for internal combustion engines as claimed in claim 1 where in said acid is alpha-methylene adipic acid.

14. A fuel composition for internal combustion engines as claimed in claim 1 where is said amine is $R'NHC_3H_6NH_2$.

15. A fuel composition for internal combustion engines as claimed in claim 1 wherein said amine is $C_{18}H_{35}NHC_3H_6NH_2$.

16. A fuel composition for internal combustion engines as claimed in claim 1 wherein said minor wear-inhibiting amount is 0.003–10 w%.

17. A fuel composition for internal combustion engines as claimed in claim 1 wherein said wear-inhibiting additive is

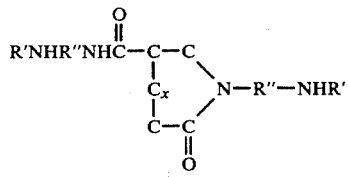

wherein x is an integer 0–2, R′ is alkyl, alkenyl, alkaryl, aralkyl, aryl, cycloalkenyl or cycloalkyl, and R″ is alkylene, cycloalkylene, aralkylene, alkarylene, or arylene, alkarylene, arylene or polyoxyakylene.

18. A fuel composition for internal combustion engines as claimed in claim 1 wherein said wear-inhibiting additive is

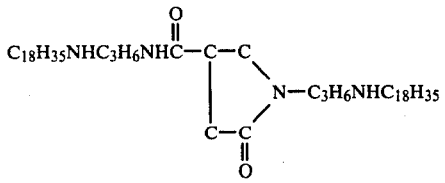

19. A composition comprising the reaction product of (a) a major portion of a fuel containing (i) at least one alcohol selected from the group consisting of ethanol and methanol and (ii) gasoline in amount of 0–50 volumes per volume of alcohol; and (b) a minor wear-inhibiting amount of, as a wear-inhibiting additive, a reaction product of one mole of the acid

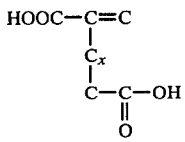

wherein x is an integer 0–2; and two moles of the amine $R'NH\ R''NH_2$ wherein R′ is an alkyl, alkenyl, alkaryl, aralkyl, aryl, cycloalkenyl or cycloalkyl and R″ is an alkylene, cycloalkylene, aralkylene, alkarylene, or arylene or polyoxyalkylene.

20. A composition as claimed in claim 19 wherein said acid is itaconic acid.

21. A composition as claimed in claim 19 wherein said acid is alpha-methylene glutaric acid.

22. A composition as claimed in claim 19 wherein said acid is alpha-methylene adipic acid.

23. A composition as claimed in claim 19 wherein said amine is $R'NHC_3H_6NH_2$.

24. A composition as claimed in claim 19 wherein said amine is $C_{18}H_{35}NHC_3H_6NH_2$.

25.

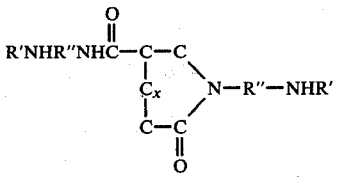

wherein x is an integer 0–2, R′ is alkyl, alkenyl, alkaryl, aralkyl, aryl, cycloalkenyl or cycloalkyl, and R″ is alkylene, cycloalkylene, aralkylene, alkarylene, or arylene, alkarylene, or arylene or polyoxyalkylene.

26.

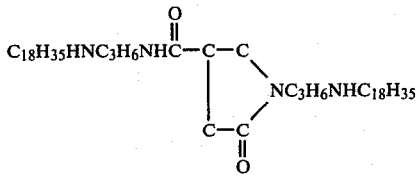

* * * * *

UNITED STATES PATENT AND TRADEMARK OFFICE

CERTIFICATE OF CORRECTION

PATENT NO. : 4,412,845

DATED : November 1, 1983

INVENTOR(S) : B. J. Kaufman and W. M. Sweeney

It is certified that error appears in the above—identified patent and that said Letters Patent is hereby corrected as shown below:

Column 3, line 36, correct the spelling of "cycloalkyl".

Claim 19, line 1, cancel "the reaction product of"..

Signed and Sealed this

*Third* Day of *April 1984*

[SEAL]

*Attest:*

GERALD J. MOSSINGHOFF

*Attesting Officer*

*Commissioner of Patents and Trademarks*